US006416920B1

(12) United States Patent
Hopper et al.

(10) Patent No.: US 6,416,920 B1
(45) Date of Patent: Jul. 9, 2002

(54) TONER COAGULANT PROCESSES

(75) Inventors: Michael A. Hopper, Toronto; Raj D. Patel, Oakville; Daryl Vanbesien, Woodbridge, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/810,138

(22) Filed: Mar. 19, 2001

(51) Int. Cl.[7] ..... G03G 9/08
(52) U.S. Cl. ..... 430/137.14; 513/333
(58) Field of Search ..... 430/137.14; 523/333

(56) References Cited

U.S. PATENT DOCUMENTS

| | | | | |
|---|---|---|---|---|
| 3,674,736 | A | 7/1972 | Lerman et al. | 260/41 R |
| 4,137,188 | A | 1/1979 | Uetake et al. | 252/62.1 P |
| 4,558,108 | A | 12/1985 | Alexandru et al. | 526/340 |
| 4,797,339 | A | 1/1989 | Maruyama et al. | 430/109 |
| 4,983,488 | A | 1/1991 | Tan et al. | 430/137 |
| 4,996,127 | A | 2/1991 | Hasegawa et al. | 430/109 |
| 5,066,560 | A | 11/1991 | Tan et al. | 430/137 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,346,797 | A | 9/1994 | Kmiecik-Lawrynowicz et al. | 430/137 |
| 5,348,832 | A | 9/1994 | Sacripante et al. | 430/109 |
| 5,364,729 | A | 11/1994 | Kmiecik-Lawrynowicz et al. | 430/137 |
| 5,366,841 | A | 11/1994 | Patel et al. | 430/137 |
| 5,370,963 | A | 12/1994 | Patel et al. | 430/137 |
| 5,403,693 | A | 4/1995 | Patel et al. | 430/137 |
| 5,405,728 | A | 4/1995 | Hopper et al. | 430/137 |
| 5,418,108 | A | 5/1995 | Kmiecik-Lawrynowicz et al. | 430/137 |
| 5,496,676 | A | 3/1996 | Croucher et al. | 430/137 |
| 5,501,935 | A | 3/1996 | Patel et al. | 430/137 |
| 5,527,658 | A | 6/1996 | Hopper et al. | 430/137 |
| 5,585,215 | A | 12/1996 | Ong et al. | 430/107 |
| 5,650,255 | A | 7/1997 | Ng et al. | 430/137 |
| 5,650,256 | A | 7/1997 | Veregin et al. | 430/137 |
| 5,723,253 | A | 3/1998 | Higashino et al. | 430/166 |
| 5,744,520 | A | 4/1998 | Kmiecik-Lawrynowicz et al. | 523/334 |
| 5,747,215 | A | 5/1998 | Ong et al. | 430/137 |
| 5,763,133 | A | 6/1998 | Ong et al. | 430/137 |
| 5,766,818 | A | 6/1998 | Smith et al. | 430/137 |
| 5,804,349 | A | 9/1998 | Ong et al. | 430/110 |
| 5,827,633 | A | 10/1998 | Ong et al. | 430/137 |
| 5,840,462 | A | 11/1998 | Foucher et al. | 430/137 |
| 5,853,944 | A | 12/1998 | Foucher et al. | 430/137 |
| 5,869,215 | A | 2/1999 | Ong et al. | 430/137 |
| 5,994,020 | A | 11/1999 | Patel et al. | 430/137 |
| 6,130,021 | A | 10/2000 | Patel et al. | 430/137 |
| 6,132,924 | A | 10/2000 | Patel et al. | 430/137 |
| 6,294,595 | B1 * | 9/2001 | Tyagi et al. | 523/333 |

OTHER PUBLICATIONS

Webster's II New Riverside Dictionary. The Riverside Publishing Company (1984). p. 98.*

* cited by examiner

*Primary Examiner*—Christopher RoDee
(74) *Attorney, Agent, or Firm*—E. O. Palazzo

(57) ABSTRACT

A process for the preparation of toner by, for example, mixing a colorant, a latex, optionally a wax and a water solubilized silica with an alumina coating or an aluminized silica as a coagulant.

27 Claims, No Drawings

TONER COAGULANT PROCESSES

PENDING APPLICATIONS AND PATENTS

In copending application U.S. Ser. No. 922,437, abandoned the disclosure of which is totally incorporated herein by reference, there is illustrated, for example, a process for the preparation of toner comprising (i) aggregating with a metal complex, or metal ion a colorant dispersion with a latex emulsion and optional additives to form aggregates;

(ii) coalescing or fusing the aggregates; and optionally (iii) isolating, washing, and drying the toner.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence and wherein one of the coagulants may be polyaluminum chloride.

In copending application U.S. Ser. No. 09/551,465, now U.S. Pat. No. 6,268,102 the disclosure of which is totally incorporated herein by reference, there is illustrated a process for the preparation of toner comprising mixing a colorant, a latex, and two coagulants, followed by aggregation and coalescence, and wherein one of the coagulants is a polyaluminum sulfosilicate.

Also illustrated in U.S. Pat. No. 5,994,020 and U.S. Pat. No. 6,130,021, the disclosures of which are totally incorporated herein by reference, are toner preparation processes, and more specifically, a process for the preparation of toner comprising (i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex. or emulsion blend comprised of resin contained in a mixture of an anionic surfactant and a nonionic surfactant in the presence of a coagulant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin to initiate aggregation; optionally adding an ionic surfactant stabilizer; heating at a temperature about equal to, or about above about the Tg of the latex resin; and optionally cooling, isolating, washing, and drying the toner.

The appropriate components and processes of the above recited copending applications and patents may be selected for the processes of the present invention in embodiments thereof.

BACKGROUND OF THE INVENTION

The present invention is generally directed to toner processes, and more specifically, to chemical processes which involve the aggregation and fusion of latex resin, colorant like pigment, or dye, and additive particles into toner particles, and wherein aggregation can be primarily controlled by utilizing a cationic coagulant of a silica, such as a colloidal silica with an alumina coating, that is for example, a colloidal dispersion of discrete spherical silica particles of pure, about 100 percent, amorphous silicon dioxide and wherein the surface is modified to attain cationic properties with a coating of $Al_2O_3$ on the silica core thereby providing a functionalized colloidal silica, which silica is commercially available and is commercially used in water purification industries, and wherein there is selected a latex comprised, for example, of submicron resin particles in the size range of, for example, about 0.1 to about 0.3 micron in volume average diameter, suspended in an aqueous phase comprised of a mixture of water, an anionic surfactant and a colorant dispersion comprising submicron pigment particles in the size range of, for example, about 0.08 to about 0.3 micron in volume average diameter as measured by a disc centrifuge suspended in an aqueous phase of water and an anionic surfactant and optionally a nonionic surfactant or mixtures thereof, which are blended together in the presence of a coagulant, and wherein the resultant blend is stirred and heated to a temperature below the resin Tg, resulting in aggregates to which optionally is added a second latex to provide a coating on the formed toner aggregates, followed by adjusting the pH of the mixture with a base, and heating the mixture to a temperature above the resin Tg, followed by adjusting the pH of the mixture with an acid to fuse the aggregates. More specifically, the present invention is generally directed to the aggregation and coalescence or fusion of latex, colorant like pigment, dye, and additives like a wax in the presence of colloidal aluminized silica, which is, for example, in the diameter size range of about 0.005 about 0.2 micron, and wherein there are generated toner compositions with, for example, a volume average diameter of from about 1 micron to about 25 microns, and more specifically, from about 2 microns to about 12 microns, and with a narrow particle size distribution of, for example, from about 1.10 to about 133, and more specifically, a size distribution in the range of about 1.11 to about 1.28, the size and size distribution being measured by a Goulter Counter without the need to resort to conventional pulverization and classification methods. Furthermore, the present invention in embodiments enables minimum washings, for example about 2 to about 4 washings to provide a suitable toner triboelectrical charge in the range of about −40 to about −20 $\mu$C/g at 20 percent RH. The toners generated can be selected for known electrophotographic imaging and printing processes, including digital color processes such as the Xerox 5090 or the Xerox Docutech 265.

Toners prepared by the process of the present invention possess a number of advantages as compared to a number of known emulsion aggregation processes, which advantages include, for example, the ability to control the finish of the fused developed toner image, for example a glossy or a matte image by controlling the amount of the colloidal aluminized silica used as the coagulant, wherein the lower the concentration of the aluminized silica in a toner formulation, for example less than about 3.5 percent by weight of the toner, there results a glossy image.

Another advantage of the present invention in embodiments resides in using a colloidal aluminized silica as a coagulant to allow for the full incorporation of the silica into the toner particles as compared to using colloidal silica in the toner formulation, which is then aggregated with other known coagulants, such as polyaluminum chloride (PAC) or polyaluminum sulfosilicate (PASS) wherein the silica retention for the latter two situations is, for example, less than about 20 percent. Furthermore, another advantage of the present invention in embodiments resides in an increase of reactor productivity by 50 to 60 percent as compared to a number of known emulsion aggregation processes where the coagulants utilized are PAC and PASS. Additionally, with the invention processes in embodiments toner washing can be reduced by about 60 to about 75 percent and the triboelectric charging values of the toner obtained remain substantially constant irrespective of the colorant selected. Furthermore, when the toners generated are roll milled and aged over a period of, for example, about 2 to about 3 hours there results stable and negative toner charging with, for example, no or minimal wrong sign positively charged toner.

The toners generated with the processes of the present invention are especially useful for imaging processes, especially xerographic processes, which usually require toner transfer efficiency in excess of greater than about 90 percent, such as those with a compact machine design without a cleaner or those that are designed to provide high quality colored images with excellent image resolution, acceptable signal-to-noise ratio, and image uniformity.

PRIOR ART

In xerographic systems, especially color systems, small sized toners of preferably from about 2 to about 8 microns volume average diameter are of value to the achievement of high image quality for process color applications. Also, of value is to achieve a low image pile height to eliminate, or minimize image feel and avoid paper curling after fusing. Paper curling can be present in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it is desired in some instances to select certain toner particle sizes, such as from about 2 to about 15 microns, and with a high colorant, especially pigment loading such as from about 4 to about 15 percent by weight of toner, so that the mass of toner for attaining a certain optical density and color gamut can be reduced to eliminate or minimize paper curl. Lower toner mass also ensures the achievement of image uniformity. However, higher pigment loadings often adversely affect the charging behavior of toners. For example, the toner charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes of the present invention minimize, or avoid these disadvantages.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, the disclosure of which is totally incorporated herein by reference, wherein there is disclosed a process for the preparation of toners by resin emulsion polymerization, wherein similar to the '127 patent certain polar resins are selected; and U.S. Pat. No. 4,558,108, the disclosure of which is totally incorporated herein by reference, wherein there is disclosed a process for the preparation of a copolymer of styrene and butadiene by specific suspension polymerization. Other prior art includes U.S. Pat. Nos. 3,674,736; 4,137,188 and 5,066,560, the disclosures of which are totally incorporated herein by reference.

Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 65,346,797; and also of interest may be U.S. Pat. Nos. 5,348,832; 5,405,728; 5,366,841; 5,496,676; 5,527,658; 5,585,215; 5,650,255; 5,650,256, 5,501,935, 5,723,253, 5,744,520, 5,763,133, 5,766,818, 5,747,215, 5,827,633, 5,853,944, 5,804,349, 5,840,462, and 5,869,215. The appropriate components and processes of the above Xerox Corporation patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersion thus enabling the achievement of high color print quality, and wherein a halide, such as a chloride coagulant, can be avoided.

Also, in another feature of the present invention there is provided a process for preparing of black or colored magnetic toners, enabling toners for Magnetic Ink Character Recognition (MICR) applications.

In another feature of the present invention resides the preparation of black or colored toners, which when fused results in a glossy or a matte finish depending on the coagulant concentration, for example a toner formulation containing higher concentrations of colloidal aluminized silica will result in a matte type of a finish when the concentration of the aluminized silica is equal to or greater than about 5 percent by weight of toner, and wherein matte finish, for example, is considered to be less than about 40 GGU, or wherein a toner formulation with less colloidal aluminized silica, for example equal to or less than about 3.5 percent by weight of toner, can result in a glossy finish which is generally greater than 40 GGU.

In another feature of the present invention there is provided a process of preparing toners with an increased yield wherein the yield is increased by 50 to 60 percent as compared to a number of known emulsion aggregation processes.

Further, in another feature of the present invention there are provided processes capable of generating acceptable stable toner triboelectrical toner values with minimum toner washings.

In yet another feature of the present invention there is provided a process in which only a portion of the coagulant is introduced in the blending of latex and colorant, and wherein the remainder of the coagulant is introduced prior to or during aggregation.

Additionally, in a further feature of the present invention there is provided a process for the preparation of toner with a volume average diameter of from about 1 to about 25 microns, and preferably from about 2 to about 12 microns, and a particle size distribution of about 1.10 to about 1.28, and preferably from about 1.15 to about 1.25, each as measured by a Coulter Counter without the need to resort to conventional classifications to narrow the toner particle size distribution.

Moreover, in a further feature of the present invention there are provided processes for the preparation of toner by aggregation and coalescence, or fusion (aggregation/coalescence) of latex resin, colorant, and additive particles, and wherein there can be selected a latex prepared by batch. emulsion polymerization process or prepared by semicontinuous polymerizations.

In yet another feature of the present invention there are provided toner compositions with low fusing temperatures of, for example, from about 120° C. to about 185° C., and which toner compositions exhibit excellent blocking characteristics, for example, at and above about, or equal to about 45° C.

In still a further feature of the present invention there are provided toner compositions which provide high image projection efficiency, such as for example over 75 percent as measured by the Match Scan II spectrophotometer available from Million-Roy.

Aspects of the present invention relate to a process for the preparation of toner comprising mixing a colorant, a latex, optionally a wax and a colloidal silica with an alumina coating, that is, for example, a colloidal coated aluminized silica as a coagulant; a process for the preparation of toner comprising mixing a colorant, a latex, and a coated aluminized silica as a coagulant, and which coagulant assists in permitting aggregation and coalescence of colorant, latex resin, and when present wax; a process wherein the colorant is a colorant dispersion comprised of (i) a colorant, water, an ionic surfactant, or a nonionic surfactant, and wherein the latex selected is an emulsion comprised of an anionic surfactant, water and resin;

(ii) wherein the colorant dispersion is blended with the latex emulsion, and thereafter optionally adding a wax dispersion comprised of submicron wax particles in the size range of from about 0.1 to about 0.5 micron in diameter by volume, which wax is dispersed in an ionic surfactant of the same charge polarity of the latex ionic surfactant present;

(iii) adding to the resulting blend the coated colloidal aluminized silica to thereby initiate flocculation or aggregation of the resin latex and the colorant;

(iv) heating the resulting mixture below about the glass transition temperature (Tg) of the latex resin to form toner sized aggregates;

(v) optionally adding a latex comprised of resin particles suspended in an aqueous phase containing an anionic surfactant;

(vi) adding to the resulting mixture a base to thereby arrive at a pH of from about 5 to about 8 for the resulting toner aggregate mixture;

(vii) heating the resulting aggregate suspension of (vi) above about to the Tg of the latex resin;

(viii) optionally retaining the mixture (vii) at temperature in the range of from about 70° C. to about 95° C. for a period of, for example, about 10 to about 60 minutes, followed by a pH reduction with an acid to arrive at a pH in the range of about 3.5 to about 5 to assist in permitting the fusion or coalescence of the toner aggregates;

(ix) separating and washing the resulting toner slurry; and (x) isolating the toner; a process wherein the base is selected from the group consisting of sodium hydroxide, potassium hydroxide, and ammonium hydroxide; a process wherein the acid is selected from the group consisting of nitric acid, sulfuric acid, hydrochloric acid, citric acid or acetic acid; a process wherein there is added to the formed toner aggregates a second latex comprised of submicron resin particles suspended in an aqueous phase containing an ionic surfactant, and wherein the second latex is selected in an amount of about 10 to about 40 percent by weight of the initial latex (i) to form a shell on the first latex; a process wherein the added latex contains the same resin as the initial latex, or wherein the added latex contains a dissimilar resin than that of the initial latex (i); a process wherein the aggregation (iv) is accomplished by heating at a temperature below about the glass transition temperature of the polymer contained in the latex; a process wherein the coalescence (vii) is accomplished by heating at a temperature of above about the glass transition temperature of the polymer contained in the latex; a process wherein the aggregation temperature is from about 40° C. to about 60° C.; a process wherein the coalescence temperature is from about 75° C. to about 97° C.; a process wherein the temperature at which the aggregation is accomplished controls the size of the aggregates, and wherein the final toner size is from about 2 to about 15 microns in volume average diameter; a process wherein the aggregation (iv) temperature is from about 45° C. to about 58° C., and wherein the coalescence or fusion temperature of (vii) and (viii) is from about 85° C. to about 95° C.; a process wherein the colorant is a pigment, and wherein the pigment is in the form of dispersion, and which dispersion contains an ionic surfactant, and wherein the colloidal aluminized silica functions primarily as a coagulant and enables aggregation of the latex and the colorant; a process wherein the colorant is carbon black, cyan, yellow, magenta, or mixtures thereof; a process wherein the toner isolated is from about 2 to about 25 microns in volume average diameter, and the particle size distribution (GSD) thereof is from about 1.15 to about 1.30; and wherein there is added to the surface of the formed toner additives, such as metal salts, metal salts of fatty acids, silicas, or metal oxides, each in an amount of from about 0.1 to about 10 weight percent of the obtained toner; a process which comprises mixing a latex, surfactant and colorant; heating in the presence of a colloidal aluminized silica the resulting mixture below about, or equal to about the glass transition temperature of the latex resin; followed by the addition of a base to stabilize the toner aggregates; thereafter heating the resulting aggregates above about, or about equal to the glass transition temperature of the resin followed by a reduction in pH with and acid, followed by additional heating; and isolating, washing and drying the toner; a process wherein prior to isolating the toner heating is retained at a temperature of from about 70° C. to about 95° C. for a period of about 1 to about 6 hours and preferably about 1.5 to about 4 hours at a pH in the range of about 3.5 to about 5 until fusion or coalescence of the aggregates is accomplished; a process wherein the colloidal aluminized silica is selected in an amount of from about 0.2 to about 10 weight percent and preferably in the amount of 0.3 to 8 weight percent based on the weight of resin, colorant, and the colloidal aluminized silica; a process wherein the colloidal aluminized silica has a coating of, for example, about 0.001 to about 0.01 micron thickness of alumina ($Al_2O_3$); a process for the preparation of toner comprising the mixing of a colorant dispersion, a latex emulsion, a wax dispersion and a coated colloidal aluminized silica, and wherein the mixture is aggregated by heating below the latex resin glass transition temperature, and fusing the resulting aggregate by heating above the latex resin glass transition temperature, wherein the aggregate mixture is initially at a pH of from about 5 to about 8 followed by a reduction of the pH to about 3 to 5, and wherein the latex is comprised of resin, an ionic surfactant, and water; a process wherein the colloidal aluminized alicia functions as a coagulant and enables or assists in enablement of the aggregation; a process wherein the colorant is a colorant dispersion comprised of (i) submicron pigment particles in the size diameter range of 0.08 to 0.3 microns dispersed in water, and an ionic surfactant; the latex is a latex emulsion comprised of submicron resin particles in the size range of 0.12 to 0.5 micron suspended in water, and ionic surfactant; and wherein the (ii) colorant dispersion is blended with the latex emulsion followed by adding a wax dispersion comprised of submicron particles in the optional diameter size range of about 0.1 to about 0.4 micron dispersed in an anionic surfactant of the same charge polarity as that of the ionic surfactant in the latex emulsion;

(iii) adding to the resulting blend containing the latex and colorant a coagulant of colloidal aluminized silica to initiate flocculation or aggregation of the resin latex, colorant and wax particles;

(iv) heating the resulting mixture below or about equal to the glass transition temperature (Tg) of the latex resin to form toner sized aggregates followed by optionally adding additional colloidal aluminized silica to the formed aggregates;

(v) adding a second latex comprised of submicron resin particles suspended in an aqueous phase containing an ionic surfactant to the formed toner aggregates resulting in a shell formation the shell is, for example, of from about 0.1 to about 5 microns in thickness;

(vi) adjusting with a base the pH of the resulting toner aggregate mixture to about 5 to about 9 to primarily stabilize the aggregate particles;

(vii) heating and fusing the resulting aggregate suspension of (vi) above the Tg of the latex resin;

(viii) retaining the mixture (vii) temperature in the range of from about 70° C. to about 95° C. to initiate the fusion or coalescence of the toner aggregates, (ix) changing the pH of the above (viii) mixture with an acid to arrive at a pH in the range of about 2.8 to about 6 and preferably in the range of about 3.5 to about 5.0 to accelerate the fusion or the coalescence resulting in toner particle comprised of resin, colorant, and wax, wherein the particle size is about 2 about 25 microns;

(x) washing the resulting toner slurry; and (xi) isolating the toner; followed by drying the toner; a process wherein there is added to the formed toner aggregates a second latex in the amount of about 10 to about 40 percent by weight of the initial latex and preferably in an amount of about 15 to about 30 weight percent to form a shell or coating on the aggregates where the thickness of the shell or coating is in the range of 0.2 to 1 micron; a process wherein the added latex comprises the same resin composition and same molecular properties as the initial latex (i) used in blending or different composition and properties than that of the initial latex (i); a process wherein the aggregation is accomplished by heating at a temperature of below about the glass transition temperature of the polymer contained in the latex; a process wherein the coalescence is accomplished by heating at a temperature of about above the glass transition temperature of the polymer contained in the latex; a process wherein the aggregation temperature is from about 40° C. to about 62° C. or is from about 45° C. to about 58° C.; a process wherein the coalescence temperature is from about 75° C. to about 95° C., or from about 85° C. to about 90° C.; a process wherein there is added to the aggregate mixture prior to coalescence a base component; a process wherein the base is an alkali metal hydroxide; a process wherein the hydroxide is sodium hydroxide; a process wherein the pH of the mixture resulting after aggregation is increased from about 2 to about 2.6 to about 7 to about 8, during the coalescence, and wherein the base functions primarily as a stabilizer for the aggregates during the coalescence; a process wherein the amount of base selected is from about 8 to about 25 weight percent or is about 10 to about 20 weight percent; a process wherein the amount of metal hydroxide selected is from about 11 to about 14 weight percent; a process wherein the acid is nitric, sulfuric, hydrochloric, acetic, citric, and the like; a process wherein the amount of acid selected is from about 4 to about 30 weight percent or from about 5 to about 15 weight percent; a process wherein the pH of the mixture resulting after the initial coalescence is reduced to from about 7.5 to about 5.5 and then to 4.5 to increase the rate of fusion or coalescence; a process wherein the latex contains a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein the colorant is carbon black, cyan, yellow, magenta, red, green, blue, violet, or mixtures thereof; a process wherein the toner isolated is from about 2 to about 10 microns in volume average diameter, and the particle size distribution thereof is from about 1.15 to about 1.30, a process wherein the latex is prepared by a batch and or a semicontinuous polymerization resulting in submicron resin particles suspended in an aqueous phase containing ionic surfactant; a process where the wax is completely retained in the toner and the silica is retained in excess of about 75 percent; processes for the preparation of toner particles which toner enables excellent print quality, and document appearance, and wide processing latitude, and wherein there is selected a latex preferably comprised of submicron resin particles which are in the size range of about 0.05 to about 0.5 micron or in the size range of about 0.07 to about 0.35 micron, suspended in an aqueous water phase and an ionic surfactant selected in an amount of about 0.5 to about 5 percent, or about 0.7 to about 2 percent by weight of solids, to which is added a colorant dispersion comprising submicron, for example less than, or equal to about 0.5 micron, colorant particles, anionic surfactant which is selected in the range amount of about 0.5 to about 10.0 percent and preferably about 0.6 to about 5 percent by weight of solids, which when blended together result in a mixture with a pH in the range of about 2 to about 2.6 to which a coated colloidal aluminized silica solution containing an acid like nitric acid is added slowly over, for example, a period of about 2 to about 5 minutes, further aggregating by stirring and heating from about 5 to 10 degrees below the resin Tg, resulting in toner aggregates of a size of about 3 to about 15 microns or about 4 to about 8 microns with a narrow GSD in the range of, for example, about 1.14 to about 1.28 or in the range of about 1.17 to about 1.25, and which GSD enables the clean transfer of toner particles thereby providing enhanced resolution of the resulting developed fused images; followed by adjusting the pH of the mixture from about 2 to about 2.6 to a pH of about 6 to about 9 or about 7 to about 8.5, and preferably to a pH of about 8 with the addition of a dilute base solution of a 4 weight percent of sodium hydroxide, further stirring and increasing the mixture temperature above the resin Tg, in the range of about 70° C. to about 95° C., or in the range of about 85° C. to about 93° C. for a period of about 0.5 to about 1.5 hours, followed by changing the pH from about 8 to about 4.5 by the addition of an acid, such as dilute nitric acid, and heating the mixture for an additional about 0.5 to about 4 hours or from about 0.6 to about 3 hours, to fuse or coalesce the aggregates, and then washing and drying the toner; a toner process wherein the solids content of the colloidal aluminized silica is in the range of about 20 to about 45 weight percent and wherein the alumina:silica ratio is in the range of 1:99 to about 10:90 percent and wherein the coating of the aluminia on the colloidal aluminized silica is in the range of about 0.001 to about 0.01 micron in thickness; a toner process wherein a wax dispersion is added to the latex (i) and colorant mixture; a process wherein washing the toner particles containing the toner slurry at a pH of 11 is followed by filtration and reslurrying of the filter cake comprised of toner particles in deionized water, followed by another deionized water wash and a single wash with only water at a pH of 4 where the pH of the slurry is adjusted with an acid; and processes for the preparation of toner compositions which comprise blending an aqueous colorant dispersion containing a pigment, such as carbon black, phthalocyanine, quinacridone or RHODAMINE B™ type, red, green, orange, brown, violet, yellow, fluorescent colorants and the like, with a latex emulsion derived from the emulsion polymerization of monomers selected, for example, from the group consisting of styrene, butadiene, acrylates, methacrylates, acrylonitrile, acrylic acid, methacrylic acid, itaconic or Beta Carboxy Ethyl Acrylate (BCEA) and the like, and which latex contains an anionic surfactant, such as sodium dodecylbenzene sulfonate, and which process is accomplished in the presence of a coated aluminized silica, heating the resulting flocculent mixture at a temperature below the latex (i) resin Tg for an effective length of time of, for example, about 0.5 hour to about 3 hours to form toner sized aggregates; and optionally adding a known amount of a second or delayed. latex wherein this latex can be the same in composition as the initial latex (i) or dissimilar, followed by adjusting the pH of the mixture to from about 2 to about 8 with a dilute base solution of sodium hydroxide, and subsequently heating the aggregate suspension at a temperature above 95° C. for a period of 0.5 to 1 hour, adjusting the pH of the mixture from about 8 to about 4.5 with a dilute acid to provide toner particles, isolating the toner product by, for example, filtration, washing and drying in an oven, fluid bed dryer, freeze dryer, or spray dryer; a process for the preparation of toner comprising mixing a colorant, a latex, and a silica, which silica is coated with alumina; a process for the preparation of toner comprising mixing a colorant, a latex, and a colloidal aluminized silica coagulant, and which coagulant primarily assists in permitting aggregation and coalescence of said colorant, and said latex resin; a process for the preparation of toner comprising the mixing of a colorant dispersion, a latex emulsion, a wax dispersion and a colloidal aluminized silica, and wherein said mixture is aggregated by heating below the latex resin glass transition temperature, and thereafter fusing said resulting aggregates by heating above the latex resin glass transition temperature, wherein said aggregate mixture is at a pH of from about 5 to about 8, and wherein said latex is comprised of resin, nonionic surfactant, ionic surfactant, and water; a process wherein the aggregation (iv) is accomplished by heating at a temperature below about glass transition temperature of the polymer contained in the latex; a process wherein the coalescence (vii) is accomplished by heating at a temperature of about above the glass transition temperature of the polymer contained in the latex; a process wherein the aggregation temperature is from about 40° C. to about 60° C.; a process wherein the coalescence temperature is from about 75° C. to about 97° C.; a process wherein the base is an alkali metal hydroxide; a process wherein the hydroxide is sodium hydroxide; a process wherein said coagulant is added during or prior to aggregation of the latex resin and colorant, and which coagulant enables or initiates the aggregation; a process for the preparation of toner comprising aggregating and coalescing a colorant dispersion, a latex containing a polymer, a wax, and colloidal aluminized silica; a process wherein the aggregate pH is in the range of about 4 to about 6.8 and preferably in the range of about 4.5 to about 6; a process wherein (v) is accomplished; a process wherein the colloidal aluminized silica functions as a coagulant and enables or assists in enablement of the aggregation.

The particle size of the toner provided by the processes of the present invention in embodiments can be controlled, for example, by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter is obtained at an aggregation temperature of about 53° C.; the same latex will provide an aggregate size of about 5 microns at a temperature of about 48° C. under similar conditions.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner composition of the present invention in various suitable amounts, such as from about 75 weight percent to about 98, or from about 80 to about 95 weight percent of the toner or of the solids, and the latex resin size suitable for the processes of the present invention can be, for example, preferably from about 0.05 micron to about 0.5 micron in volume average diameter as measured by the Brookhaven nanosize particle analyzer. Other sizes and effective amounts of latex polymer may be selected in embodiments of the present invention. The total of all toner components, such as resin and colorant, is about 100 percent, or about 100 parts.

The polymer selected for the process of the present invention can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol in amounts of from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes for obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention.

Examples of waxes include those as illustrated herein, such as those of the aforementioned copending applications, and more specifically, polypropylenes and polyethylenes commercially available from Allied Chemical and Petrolite Corporation, wax emulsions available from Michaelman Inc. and the Daniels Products Company, EPOLENE N-15 commercially available from Eastman Chemical Products, Inc., VISCOL 550-P, a low weight average molecular weight polypropylene available from Sanyo Kasei K. K., and similar materials. The commercially available polyethylenes selected usually possess a molecular weight $M_w$ of from about 1,000 to about 1,500, while the commercially available polypropylenes utilized for the toner compositions of the present invention are believed to have a molecular weight of from about 4,000 to about 5,000. Examples of functionalized waxes include amines, amides, imides, esters, quaternary amines, carboxylic acids or acrylic polymer emulsion, for example JONCRYL 74, 89, 130, 537, and 538, all available from SC Johnson Wax, chlorinated polypropylenes and polyethylenes commercially available from Allied Chemical and Petrolite Corporation and SC Johnson wax.

Various known colorants, such as pigments, selected for the processes of the present invention and present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L690™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL. Colored magnetites, such as mixtures of MAPICO BLACK™, and cyan components may also be selected as colorants with the process of the present invention, wherein the colorant is present, for example, in the amount of 3 to 15 weight percent of the toner. Organic dye examples include known suitable dyes, reference the Color Index, and a number of U.S. patents. Organic soluble dye examples, preferably of a high purity for the purpose of color gamut are Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight and preferably from about 5 to 20 weight percent of the toner. Colorants include pigment, dye, mixtures of pigment and dyes, mixtures of pigments, mixtures of dyes, and the like.

Examples of initiators for the preparation of both the initial latex of (i) and the added delayed latex include water soluble initiators, such as ammonium and potassium persulfates, in suitable amounts, such as from about 0.1 to about 8 percent and preferably in the range of from about 0.2 to about 5 percent (weight percent). Examples of chain transfer agents include dodecanethiol, octanethiol, carbon tetrabromide and the like in various suitable amounts, such as in the range amount of from about 0.1 to about 10 percent and preferably in the range of from about 0.2 to about 5 percent by weight of monomer.

Surfactants for the preparation of latexes and colorant dispersions can be ionic or nonionic surfactants in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. Examples of nonionic surfactants for the pigment dispersion can be selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, The silica cationic coagulant selected is in embodiments a colloidal silica with an alumina coating, that is for example, a colloidal dispersion of discrete spherical silica particles of pure, about 95 to about 100 percent pure, amorphous silicon dioxide with a coating of $Al_2O_3$ and wherein the surface thereof is modified to attain cationic properties on the silica core thereby providing a functionalized colloidal silica or a colloidal aluminized silica. The thickness of the alumina coating on the silica core is, for example, in the range of about 0.001 to 0.01 micron, and can in embodiments be up to about 1.5 microns. These cationic silica coagulants are commercially available and can be obtained as BINDZIL™, available from Akzo Nobel, LUDOX CL™, and others available from Aldrich, and LEVASIL® from Bayer Inc.

The toner may also include known charge additives in effective suitable amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972™ available from Degussa. The coated silicas of U.S. Pat. No. 6,190,815 and U.S. Pat. No. 6,004,714, the disclosures of which are totally incorporated herein by reference, can also be selected in amounts, for example, of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,990; 4,858,884; 4,584,253 and 4,563,408, the disclosures of which are totally incorporated herein by reference.

The following Examples and Comparative Examples are provided. In these Examples, the P725 wax is a wax aqueous dispersion comprised of 30 weight percent of polyethylene wax in about 70 weight percent water, about 0.7 weight percent of an anionic surfactant of sodium dodecyl benzene sulfonate, and wherein the percent solids is 10 percent.

Latex Preparation—Semicontinuous

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2A1 (anionic emulsifier) and 387 kilograms of deionized water was prepared by mixing for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of β-CEA, 7.13 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the aqueous surfactant phase at 80° C. to form the "seeds" while being purged with nitrogen. The above initiator solution was then slowly charged into the reactor, and after minutes the remainder of the emulsion was continuously fed in using metering pumps.

Once all of the above monomer emulsion was charged into the main reactor, the temperature was maintained at 80° C. for an additional 2 hours to complete the reaction. The reactor contents were then cooled down to about 25° C. The resulting isolated product was comprised of 40 percent of submicron, 0.5 micron, resin particles of styrene/butylacrylate/βCEA suspended in an aqueous phase containing the above surfactant. The molecular properties resulting were for the resin latex throughout $M_w$ of 39,000, $M_n$10.8 and a midpoint Tg of 55.8° C.

TONER FABRICATION

EXAMPLE I

340 Grams of the above prepared latex emulsion (i) and 52 grams of an aqueous wax dispersion of polyethylene P725 wax with a molecular weight ($M_w$) of about 750 and having a solids loading of 31 percent, and 119 grams of an aqueous cyan pigment dispersion comprising 19 grams of cyan PB 15.3 pigment having a solids loading of 51 percent were simultaneously added to 600 grams of water with high shear stirring by means of a polytron. To this mixture were added 74.6 grams of a 5 weight percent coagulant of the water solubilized silica BINDZIL™ CAT 80, 0.04 micron in size diameter, and comprising a dispersion of discrete spherical silica particles of pure amorphous silicon dioxide with a coating thereover, about 100 percent coated, 0.001 to 0.01 micron in thickness of $Al_2O_3$ and a positive charge, and wherein the BINDZIL™ CAT 80 had a solids loading of 44 weight percent. The addition of the coagulant was accomplished over a period of 3 minutes, while being blended at a speed of 5,000 rpm for a period of 5 minutes. The resulting mixture was transferred to a 2 liter reaction vessel and heated at a temperature of 45° C. for 35 minutes resulting in aggregates of a size diameter (volume average) of 4.9 microns and a GSD of 1.20. To this mixture were added an additional 44 grams of the above 5 percent colloidal aluminized silica followed by allowing the mixture to aggregate for an additional 30 minutes. To the resulting aggregates 140 grams of the above prepared latex A were added followed by allowing the mixture to further aggregate for an additional 25 minutes resulting in a particle with a size of 5.6 microns and a GSD of 1.19. The pH of the resulting mixture was then adjusted from 2 to 7.8 with an aqueous base solution of 4 percent sodium hydroxide and allowed to stir for an additional 15 minutes. Subsequently, the resulting mixture was heated to 90° C. and retained there for a period of 1 hour. The measured particle size was 5.6 microns with a GSD of 1.20. The particle size had not changed, however, the pH of the mixture has fallen to 6.4. The pH was then further reduced to 5.5 using a 2.5 percent nitric acid solution. The resultant mixture was allowed to coalesce for an additional 60 minutes before further reducing the pH to 4.8 and allowed to coalesce for an additional 3 hours at a temperature of 90° C. The morphology of the toner particles was observed to be spherical under the optical microscope, and the measured (Coulter Counter) toner particle size was 5.7 with a GSD of 1.20. The reactor contents were then cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by 1 wash at a pH of 4 (nitric acid). The final toner product, after drying in a freeze dryer, was comprised of 85.5 percent of the above resin, 4.3 percent of the above pigment, 7.1 weight percent of the above wax and 2.6 percent of the above colloidal aluminized silica, and the toner particle size was 5.7 microns in volume average diameter with a particle size distribution GSD of 1.20, both as measured on a Coulter Counter. The toner morphology was shown to be spherical in shape as determined by scanning electron microscopy. The toner tribo charge as determined, for example, by the known Faraday Cage process was −28.5 and −12.1 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent dispersed therein. Silica analysis of the toner by ICP indicated a silica content of less than 0.1 percent indicating >99 percent incorporation of the toner. No wax rejection was observed in the wash waters. The dry toner was fused on a free-belt nip fuser of a seamless belt, 1.5 inches in diameter, constrained between a heated roll assembly and a fixed structure with a narrow high pressure strip. The belt moved in synchronization with the heated fuser roll because of the friction between the belt and the roll in the high pressure zone. This fuser provided fast warm up (instant on) as the assembly has minimal thermal mass requiring minimal energy to reach operating temperature. The fusing action took place over a wide zone in view of a low pressure pad that mounts under the belt forcing it in contact with the heated roll over a moderately long nip width of approximately 1 centimeter. The gloss attained was 58 GGU at a toner mass per area (TMA) of 1.05 and at a temperature of 160° C.

EXAMPLE II

Cyan Toner (5.5 Percent Colloidal Aluminized Silica):

340 Grams of the above prepared latex emulsion (i) and 52 grams of an aqueous wax dispersion of polyethylene P725 wax with a wax solids loading of 30 percent, and 69 grams of an aqueous cyan PB 15.3 pigment dispersion comprising 19 grams of cyan pigment with a pigment solids loading of 51 percent was simultaneously added to 600 grams of water with high shear stirring by means of a polytron. To this mixture were added 41 grams of a 8.5 weight percent coagulant of the water solubilized silica coated with alumina BINDZIL CAT 80™ (colloidal aluminized silica) having a solids loading of 44 weight percent. The addition of the coagulant was accomplished over a period of 3 minutes, while being blended at a speed of 5,000 rpm for a period of 5 minutes. The resulting mixture was transferred to a 2 liter reaction vessel and heated at a temperature of 49° C. for 95 minutes resulting in aggregates of a size of 4.5 microns and a GSD of 1.19. To this mixture were added an additional 109 grams of the above 10 percent colloidal aluminized silica and the mixture was allowed to aggregate for an additional 55 minutes. The aggregate particle size was 4.8 microns with a GSD of 1.19. To the resulting aggregates 130 grams of the above prepared latex A or (i) were added, and the mixture was allowed to further aggregate for an additional 30 minutes resulting in a particle size of 5.4 microns with a GSD of 1.19. The pH of the resulting mixture was then adjusted from 2 to 7.8 with an aqueous base solution of 4 percent sodium hydroxide and allowed to stir for an additional 15 minutes. Subsequently, the resulting mixture was heated to 90° C. and retained there for a period of 1 hour. The particle size measured was found to be 5.6 microns with a GSD of 1.19. The pH was then reduced to 5.5 with the addition of a 2.5 percent nitric acid solution. The resultant mixture was allowed to coalesce for an additional 40 minutes prior to further reducing the pH to 4.8, and the mixture was allowed to coalesce for a total of 5 hours at a temperature of 90° C. The morphology of the toner particles resulting was spherical under an optical microscope. The measured particle size was 5.6 with a GSD of 1.20. The reactor contents were cooled down to room temperature, about 25° C. The resulting toner slurry pH was then further adjusted to 10 with a base solution of 5 percent of potassium hydroxide and stirred for 1 hour at room temperature, followed by filtration and reslurrying of the wet cake resulting in 1 liter of water, and then stirred for 1 hour. The above process was repeated followed by one wash at a pH of 4 (nitric acid). The final toner product, after drying in a freeze dryer, was comprised of 83.5 percent of resin, 4.2 percent of pigment, 6.9 weight percent of wax and 5.5 percent of the above colloidal aluminized silica, and wherein the toner particle size was 5.7 microns in volume average diameter with a particle size distribution of 1.20 both as measured on a Coulter Counter. The toner morphology was shown to be spherical in shape as determined by scanning electron microscopy. The toner tribo charge as determined, for example, by the known Faraday Cage process was −25.5 and −11.3 microcoulombs per gram at 20 and 80 percent relative humidity, respectively, measured on a carrier with a core of a ferrite (copper, zinc containing ferrite obtained from Steward Chemicals), about 90 microns in diameter, with a coating of polymethylmethacrylate and carbon black, about 20 weight percent dispersed therein.

The above wash water was submitted for silica analysis by ICP where the silica content was found to be less than 0.1 percent indicating greater than 99 percent incorporation. No wax rejection was observed in the wash waters either. The gloss of this toner was 38 GGU at a 1.05 toner mass per area (TMA) at a temperature of 160° C. on the free-belt nip fuser of Example I.

EXAMPLE III

Cyan Toner (12 Nanometers of Colloidal Aluminized Silica—2.2 Percent):

A cyan toner was prepared in accordance with Example I with the exception that the colloidal aluminized silica, which was 12 nanometers in size, was LUDOX CL™, and the amount of this colloidal aluminized silica utilized was 110 grams or 4.6 percent solids. The toner particle size obtained was 6.4 microns with a GSD of 1.21. The final toner composition was comprised of 86.5 percent resin, 7 percent wax, 4.3 percent pigment, and 2.2 percent colloidal aluminized silica. The gloss of the toner was found to be 45 GGU at 1.05 toner mass per area at a temperature of 160° C. when fused on the free-belt nip fuser in accordance with Example I.

EXAMPLE IV

Cyan Toner (6.2 Percent, 12 Nanometers of Colloidal Aluminized Silica):

A cyan toner was prepared in accordance with Example III with the colloidal aluminized silica LUDOX CL™, 12 nanometers in size, and the amount of the colloidal aluminized silica utilized was 295 grams. 45 Grams of the colloidal aluminized silica was introduced while blending the latex, pigment and the wax while the remainder of the solids was introduced during aggregation. The toner particle size obtained was 5.7 microns with a GSD of 1.22. The final toner composition was comprised of 83 percent resin, 6.7 percent wax, 4.2 percent pigment, and 6.2 percent colloidal aluminized silica. The gloss of the toner was found to be 30 GGU at 1.05 toner mass per area at a temperature of 160° C. when fused on the free-belt nip fuser in accordance with Example I.

EXAMPLE V

Cyan Toner (3 Percent of Colloidal Aluminized Silica Mixed 12/40 Nanometers):

A cyan toner was prepared in accordance with Example I, that is repeating the process, except that the amount of latex was 291 grams and the colloidal aluminized silica was at a loading of 3.1 percent by weight of the final toner. The colloidal aluminized silica (CAS) used to prepare this toner was a combination of both the 12 nanometers of LUDOX CL™ and the 40 nanometers of BINDZIL CAT™. 60 Milliliters of a 5 weight percent aqueous solution of 12 nanometers of CAS (Solution A), together with 70 milliliters of 4.7 weight percent of an aqueous colloidal aluminized silica 80 (40 nanometers) (Solution B) were utilized in the toner preparation in the following manner. 30 Milliliters of Solution A were added as a coagulant during the blending of the pigment/latex and the wax while the remaining 30 milliliters was mixed together with Solution B which was then added once the reactor temperature had reached the aggregation temperature of 47° C. The toner particle size obtained was 5.6 microns with a GSD of 1.20. The final toner composition was comprised of 84.8 percent resin, 7.5 percent wax, 4.7 percent pigment, and 3 percent of the above mixed colloidal aluminized silica. The gloss of the toner was found to be 40 GGU at 1.05 toner mass per area at a temperature of 160° C. on the free-belt nip fuser when fused in accordance with Example 1.

EXAMPLE VI (Black Toner):

A black toner was prepared by repeating the process of Example II. The final black toner composition was comprised of 81.7 percent resin, 6.9 percent wax, 6 percent REGAL 330® pigment, and 5.5 percent of the colloidal aluminized silica coagulant.

EXAMPLE VII (Cyan Toner without Wax):

A cyan toner was prepared by repeating the process of Example I except that no wax was used. The final toner particle diameter size was 5.8 microns with a GSD of 1.20. The toner was comprised of 92.5 percent resin, 4.3 percent cyan 15.3 pigment, and 2.6 percent of the colloidal aluminized silica.

EXAMPLE VIII

Preparation of a Cyan Toner—20 Solids Loading:

480 Grams of the above prepared latex emulsion and 80 grams of the above P725 wax dispersion having a solids content of 31 percent, 30 grams of blue pigment (PB 15.3) dispersion having a solids content of 51 percent, were simultaneously added to 630 milliliters of water with high shear stirring by means of a polytron. To this mixture were added 95 grams of a coagulant of the colloidal aluminized silica BINDZIL™ Cat 80 having a solids content of 5 percent, and then the mixture was blended at a speed of 5,000 rpm for a period of 2 minutes. The resulting mixture was transferred to a 2 liter reaction vessel and stirred at 400 rpm while being heated to a temperature of 47° C. During this heat up an additional 27.5 grams of the above 5 percent colloidal aluminized silica solution were added. After 75 minutes at a temperature of 47° C., there resulted aggregates with a size of 4.6 microns and a GSD of 1.22. The reactor temperature was further raised to 50° C. and held there for an additional 75 minutes resulting in a particle size of 5.2 microns with a GSD of 1.20. 92 Grams of the above-prepared latex were then introduced into the reactor while stirring. A slight increase in viscosity was observed. After an additional 30 minutes, the particle size measured was 5.9 microns with a GSD of 1.20. The pH of the resulting mixture was then adjusted from 2 to 7.8 with aqueous base solution of 4 percent sodium hydroxide and allowed to stir for an additional 15 minutes. Subsequently, the resulting mixture was heated to 90° C. and retained there for a period of 1 hour. The measured particle size was 6 microns with a GSD of 1.20. The pH was then reduced to 5.5 using a 2.5 percent nitric acid solution. The resultant mixture was then allowed to coalesce for an additional 30 minutes before further reducing the pH to 4.8 and the components were allowed to coalesce for an additional 4 hours, resulting in a total coalescence time of 5 hours at a temperature of 90° C. The morphology of the toner particles resulting was spherical. The particle size measured was 6 microns with a GSD of 1.20. The reactor was then cooled down to room temperature and the toner particles were washed 4 times, where the first wash was conducted at pH of 11, followed by 2 washes with deionized water, and the last wash was carried out at a pH of 4.

EXAMPLE IX

Preparation of a Cyan Toner—25 Percent Solids Loading:

620 Grams of the above prepared latex emulsion (i) and 108 grams of the above P725 wax dispersion having a solids content of 31 percent, and 40 grams of blue pigment (PB 15.3) dispersion having a solids content of 51 percent, were simultaneously added to 650 milliliters of water with high shear stirring by means of a polytron. To this mixture were added 120 grams of the above coagulant of a 5 percent colloidal aluminized silica BINDZIL™ Cat 80 and blended at speed of 5,000 rpm for a period of 2 minutes. Thereafter, the resulting mixture was transferred to a 2 liter reaction vessel and stirred at 450 rpm while being heated to a temperature of 50° C. During the heat up an additional 40 grams of the above 5 percent colloidal aluminized silica solution were added. After 75 minutes at a temperature of 50° C., there resulted aggregate size of 3.8 microns and a GSD of 1.26. The reactor temperature was further raised to 52° C. and held there for an additional 150 minutes resulting in a particle size of 6.3 microns with a GSD of 1.21. 248 Grams of the above-prepared latex were then introduced into the reactor while stirring. A slight increase in viscosity was observed. After an additional 30 minutes, the particle size measured was 6.5 microns with a GSD of 1.21. The pH of the resulting mixture was then adjusted from 2 to 7.8 with aqueous base solution of 4 percent sodium hydroxide and allowed to stir for an additional 15 minutes. Subsequently, the resulting mixture was heated to 90° C. and retained there for a period of 1 hour. The measured particle size was 7 microns with a GSD of 1.20. The pH was then reduced to 4.8 using a 2.5 percent nitric acid solution. The resultant mixture was then allowed to coalesce for an additional 4 hours, resulting in a total coalescence time of 5 hours at a temperature of 90° C. The morphology of the toner particles was spherical, and the toner particle size was 7 microns in diameter at about 25° C.

Other modifications of the present invention may occur to those skilled in the art subsequent to a review of the present application, and these modifications, including equivalents thereof, are intended to be included within the scope of the present invention.

What is claimed is:

1. A process for the preparation of toner comprising mixing a colorant, a latex, and a silica, which silica is coated with an alumina, and aggregating and coalescing said colorant and latex to form said toner.

2. A process in accordance with claim 1 wherein (i) said colorant is a colorant dispersion comprised of colorant, water, and an anionic surfactant, or a nonionic surfactant, and wherein said latex is an emulsion comprised of an ionic surfactant, water and resin in the optional ratio of 1.5:58.5:40 weight percent; and further (ii) wherein said colorant dispersion is blended with said latex emulsion, and thereafter optionally adding a wax dispersion comprised of submicron wax particles in the size range of from about 0.1 to about 0.5 micron in diameter by volume, which wax is dispersed in an ionic surfactant of the same charge polarity of said anionic latex surfactant;

(iii) adding to the resulting blend said silica coated with an alumina to thereby initiate flocculation or aggregation of said resin in said latex emulsion, said colorant, and said wax when present;

(iv) heating the resulting mixture below about, or about equal to the glass transition temperature (Tg) of the latex resin to form toner sized aggregates;

(v) adding a second latex comprised of resin suspended in an aqueous phase containing an ionic surfactant and water;

(vi) adding to the resulting mixture a base to thereby change the pH which is in the range of about 2 to about 2.9 to arrive at a pH of from about 5 to about 8 for the resulting toner aggregate mixture;

(vii) heating the resulting aggregate suspension of (vi) above about, or about equal to the Tg of the latex resin of (i);

(viii) retaining the mixture temperature in the range of from about 70° C. to about 95° C. optionally for a period of about 10 to about 60 minutes, followed by a pH reduction with an acid to arrive at a pH in the range of about 3.5 to about 5 to assist in permitting the fusion or coalescence of the toner aggregates;

(ix) optionally washing the resulting toner slurry; and (x) isolating the toner.

3. A process in accordance with claim 2 wherein the latex emulsion comprises submicron resin particles in the size range of about 0.1 to about 0.4 micron in diameter.

4. A process in accordance with claim 2 wherein the latex resin particle size is in the range of about 0.15 to about 0.3 micron in volume average diameter.

5. A process in accordance with claim 2 wherein the colorant is a pigment, a dye or mixtures thereof, and which colorant optionally is submicron in size in the range of about 0.08 to about 0.34 micron in average volume diameter.

6. A process in accordance with claim 2 wherein said base is selected from the group consisting of sodium hydroxide, potassium hydroxide, and ammonium hydroxide.

7. A process in accordance with claim 2 wherein in step (v) there is added to the formed toner aggregates a second latex comprised of submicron resin particles suspended in an aqueous phase containing an anionic surfactant, and wherein said second latex is selected in an amount of from about 10 to about 40 percent by weight of the initial latex to form a shell thickness of about 0.2 to about 0.8 micron on said formed aggregates.

8. A process in accordance with claim 7 wherein the added latex contains the same resin as the initial latex of (i).

9. A process in accordance with claim 7 wherein said added latex contains a dissimilar resin than that of the initial latex.

10. A process in accordance with claim 2 wherein the pH of the mixture resulting in (vi) is increased from about 2 to about 2.6 to about 5 to about 8, and wherein said base functions primarily as a stabilizer for the aggregates during coalescence (vii), and no or minimal particle size or GSD increases result.

11. A process in accordance with claim 2 wherein the temperature at which toner sized aggregates are formed controls the size of the aggregates, and wherein the final toner size is from about 2 to about 15 microns in volume average diameter.

12. A process in accordance with claim 2 wherein the aggregation (iv) temperature is from about 45° C. to about 60° C., and wherein the coalescence or fusion temperature of (vii) is from about 85° C. to about 95° C.

13. A process in accordance with claim 2 wherein the colorant is carbon black, cyan, yellow, magenta, orange, green, violet or mixtures thereof; the toner isolated is from about 2 to about 15 microns in volume average diameter; and wherein there is added to the surface of the formed toner metal salts, metal salts of fatty acids, silicas, metal oxides, or mixtures thereof, each in an amount of from about 0.1 to about 10 weight percent of the obtained toner.

14. A process in accordance with claim 2 wherein said coated silica is a colloidal dispersion of discrete spherical particles of pure amorphous silicon dioxide, and wherein the surface thereof has an alumina coating of $Al_2O_3$.

15. A process in accordance with claim 14 wherein the alumina ($Al_2O_3$) coating has a thickness which is in the range of about 0.001 to about 0.01 micron, and wherein (ix) is accomplished.

16. A process in accordance with claim 1 wherein said coated silica is selected in an amount of from about 0.05 to about 10 percent by weight of latex resin, colorant, and silica, and wherein said latex resin, coagulant, and silica amount totals about 100 percent.

17. A process in accordance with claim 1 wherein said coated silica is selected in an amount of from about 0.1 to about 10 percent by weight of latex resin, colorant and silica.

18. A process in accordance with claim 1 wherein the colorant is a pigment, and wherein said pigment is in the form of dispersion, and which dispersion contains an ionic surfactant and optionally a nonionic surfactant, and wherein said coated silica is of a colloidal size and functions as a coagulant and assists in the enablement of aggregation of said latex and said colorant.

19. A process in accordance with claim 1 wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

20. A process in accordance with claim 1 which comprises mixing said latex, and colorant; heating in the presence of said coated silica,. heating the resulting mixture. below about the glass transition temperature of the resin contained in the latex; followed by the addition of a base to stabilize the toner aggregates; thereafter heating the resulting aggregates above about, or about equal to the glass transition temperature of the resin contained in the latex, followed by a reduction in pH; followed by further heating until fusion or coalescence of said aggregates is accomplished, and. isolating said toner.

21. A process in accordance with claim 20 wherein prior to isolating said pH of the mixture is reduced followed by heating at a temperature of from about 70° C. to about 95° C. until fusion or coalescence of said aggregates is accomplished.

22. A process on accordance with claim 1 wherein said coated silica is water solubilized in a slightly acidic pH environment, and wherein the pH is in the range of about 3 to about 6.5.

23. A process in accordance with claim 1 wherein said coating on said silica is of a thickness of from about 0.005 to about 0.02 micron.

24. A process for the preparation of toner comprising mixing a colorant, a latex, and as a coagulant a colloidal silica and which silica is coated with an alumina, and which coagulant primarily assists in permitting aggregation and coalescence of said colorant, and said latex resin, and wherein said aggregation and coalence is accomplished.

25. A process in accordance with claim 24 wherein said colloidal for said coated silica is in the size range of about 0.005 to about 0.1 micron in diameter.

26. A process in accordance with claim 24 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylatea-crylononitrile), and poly (styrene-butyl acrylate-acrylononitrile-acrylic acid).

27. A process for the preparation of toner comprising the mixing of a colorant dispersion, a latex emulsion, a wax dispersion and a colloidal silica which silica is coated with an alumina, and wherein said mixture is aggregated by heating below the latex resin glass transition temperature, and thereafter fusing said resulting aggregates by heating above the latex resin glass transition temperature, wherein said aggregate mixture is at a pH of from about 5 to about 8, and wherein said latex is comprised of resin, nonionic surfactant, ionic surfactant, and water.

* * * * *